US007917075B2

(12) United States Patent
Sone et al.

(10) Patent No.: US 7,917,075 B2
(45) Date of Patent: Mar. 29, 2011

(54) FIXING DEVICE

(75) Inventors: Toshihiro Sone, Yokohama (JP); Osamu Takagi, Chofu (JP); Satoshi Kinouchi, Shinjuku (JP); Yoshinori Tsueda, Fuji (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 43 days.

(21) Appl. No.: 12/535,269

(22) Filed: Aug. 4, 2009

(65) Prior Publication Data

US 2010/0034568 A1 Feb. 11, 2010

Related U.S. Application Data

(60) Provisional application No. 61/086,777, filed on Aug. 6, 2008.

(51) Int. Cl.
*G03G 15/20* (2006.01)

(52) U.S. Cl. ..... 399/329; 399/334

(58) Field of Classification Search ..... 399/320–334
See application file for complete search history.

(56) References Cited

U.S. PATENT DOCUMENTS 5,300,996 A * 4/1994 Yokoyama et al. ..... 399/69

FOREIGN PATENT DOCUMENTS

JP 2006-154608 A 6/2006

OTHER PUBLICATIONS

U.S. Appl. No. 12/401,244, Tsueda.

* cited by examiner

*Primary Examiner* — Hoang Ngo
(74) *Attorney, Agent, or Firm* — Patterson & Sheridan, LLP

(57) ABSTRACT

To provide a technique for preventing a temperature rise in a non-sheet passing areas in a fixing device. The fixing device includes: a heating rotational member that includes at least one roller and heats a toner transferred on a sheet; a pressing roller that nips and carries the sheet in cooperation with the heating rotational member; a heating device that heats the heating rotational member; and heat pipes arranged, on the inside of at least one of the roller of the heating rotational member and the pressing roller, in ranges on both the sides in an axial direction of the roller from positions closer to the center in the axial direction than both the ends of a minimum sheet passing range in the axial direction of the roller of the nipped and carried sheet to positions further on the outer sides in the axial direction than both the ends of a maximum sheet passing range.

20 Claims, 12 Drawing Sheets

FIXING DEVICE

CROSS-REFERENCE TO RELATED APPLICATION

This application is based upon and claims the benefit of priority from: U.S. provisional application 61/086,777, filed on Aug. 6, 2008, the entire contents of each of which are incorporated herein by reference.

TECHNICAL FIELD

The present invention relates to a fixing device.

BACKGROUND

In an image forming apparatus such as a multi function peripheral (MFP), as a device that fixes a toner on a sheet, a fixing device including a fixing roller that heats and melts the toner and a pressing roller that comes into press contact with the fixing roller to form a nip section between the pressing roller and the fixing roller and compression-bonds the melted toner on the sheet is used.

The fixing roller is heated by induction-heating a conductive layer of the fixing roller with, for example, an induction heating coil (IH coil) and heats and melts the toner with the heat of the induction heating. When the fixing roller is heated over the entire area in an axial direction thereof, if sheets having width smaller than a heating range of the fixing roller are continuously caused to pass, heat is not deprived by the sheets in areas on the outer sides where the sheets do not pass. Therefore, temperature rises higher than that in an area where the sheets pass.

To solve this problem of the temperature rise and realize energy saving, a fixing device in which an IH coil is divided in the width direction of a fixing roller is proposed. In such a fixing device, it is possible to feed an electric current only to IH coils arranged in a range corresponding to a range where sheets to be subjected to fixing processing pass and heat a necessary range of the fixing roller. Consequently, even when small-size sheets are continuously subjected to the fixing processing, since an area where the sheets do not pass is not heated, the temperature rise does not occur and the energy saving can be attained.

However, in general, the IH coil of the dividing type is divided into three blocks including an IH coil located in the center in a passing range of sheets and IH coils arranged on both the sides of the passing range. If the number of divisions is increased, a circuit for driving the IH coils is complicated and control of the IH coils is complicated to cause an increase in cost. Therefore, when the passing range of the continuously passing sheets and a range heated by the IH coils do not coincide with each other, in the fixing roller and a fixing belt, the temperature in non-sheet passing areas still rises to cause temperature fluctuation in the axial direction.

SUMMARY

It is an object of an embodiment of the invention to provide a technique for preventing the temperature rise in the non-sheet passing areas in the fixing device.

To solve the problems explained above, according to an aspect of the invention, there is provided a fixing device including: a heating rotational member that includes at least one roller and heats a toner transferred on a sheet; a pressing roller that nips and carries the sheet in cooperation with the heating rotational member; a heating device that heats the heating rotational member; and heat pipes arranged, on the inside of at least one of the roller of the heating rotational member and the pressing roller, in ranges on both the sides in an axial direction of the roller from positions closer to the center in the axial direction than both the ends of a minimum sheet passing range in the axial direction of the roller of the nipped and carried sheet to positions further on the outer sides in the axial direction than both the ends of a maximum sheet passing range.

According to another aspect of the invention, there is provided a fixing device including: a heating rotational member that includes at least one roller and heats a toner transferred on a sheet; a pressing roller that nips and carries the sheet in cooperation with the heating rotational member; a center IH coil that heats, in the at least one roller included in the heating rotational member, a first range wider than a minimum sheet passing range in an axial direction of the roller of the nipped and carried sheet; side IH coils that heats, in the at least one roller included in the heating rotational member, second ranges located on both the sides of the heating range of the center IH coil in the axial direction; and heat pipes dividedly arranged in the axial direction on the inside of at least one of the at least one roller included in the heating rotational member and the pressing roller and arranged in a range in the axial direction from positions closer to the center in the axial direction than both the ends of the minimum sheet passing range to positions further on the outer sides than side ends of the first range in the second range.

DETAILED DESCRIPTION

Embodiments of the invention are explained below with reference to the drawings.

First Embodiment

Figure 1:
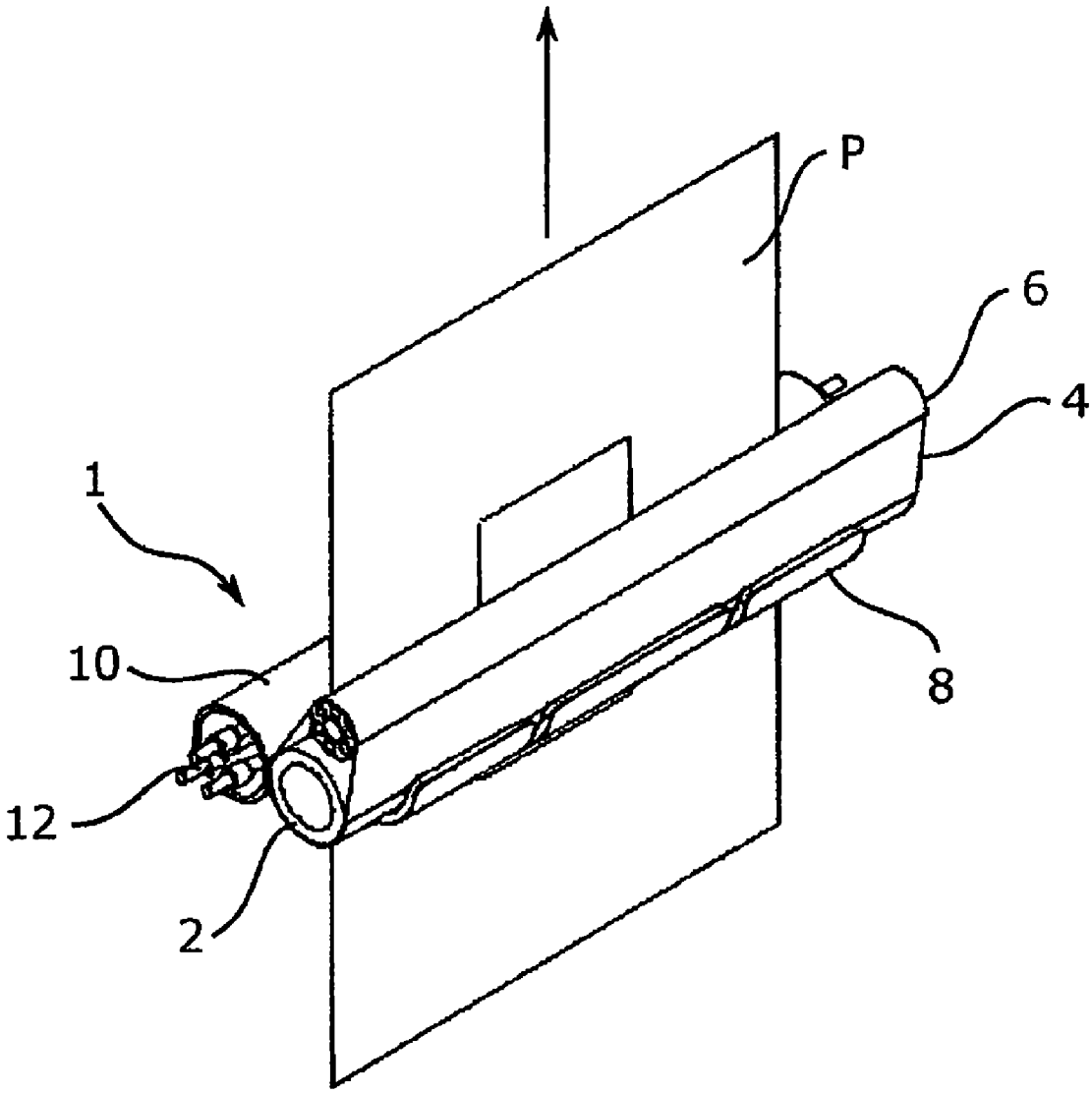
FIG. 1 is a perspective view of a fixing device according to a first embodiment of the invention.
Figure 2:
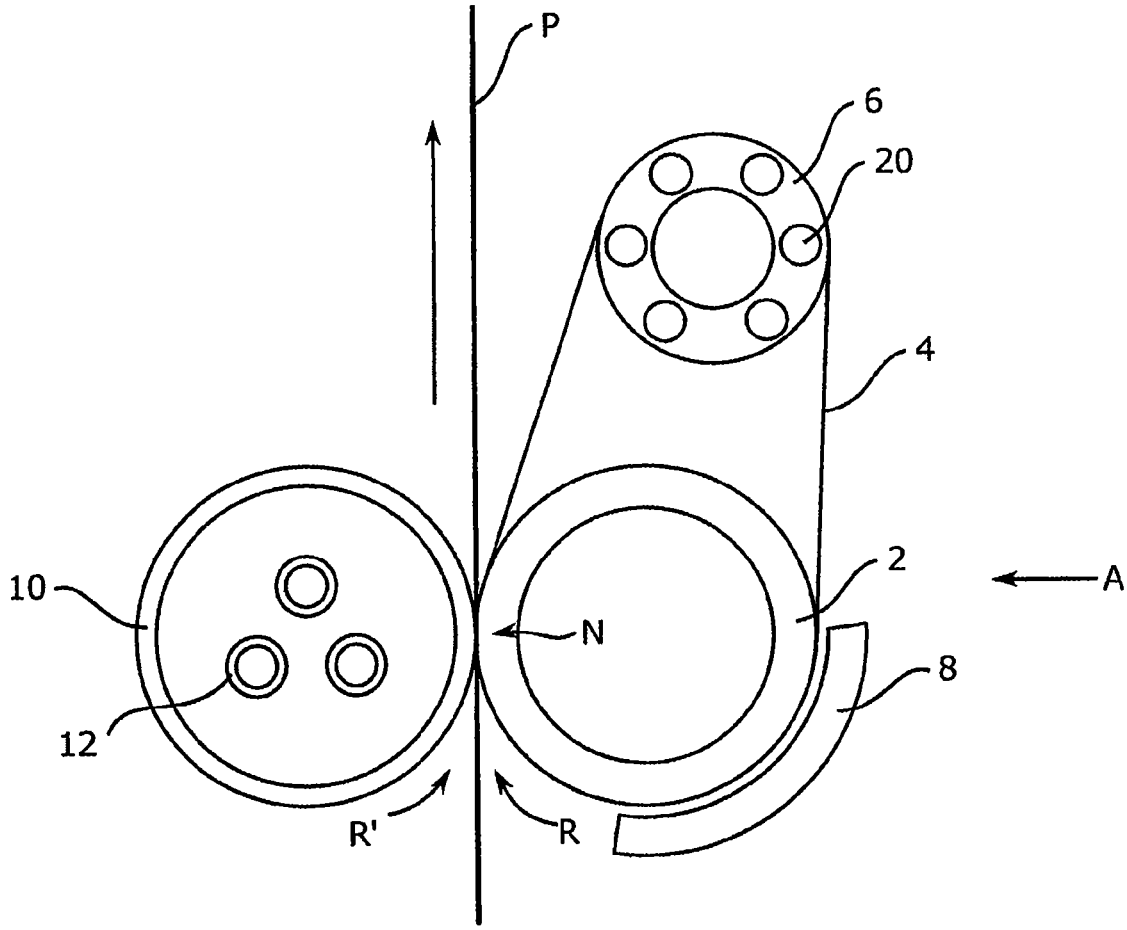
FIG. 2 is a side view of the fixing device shown in FIG. 1.
Figure 3:
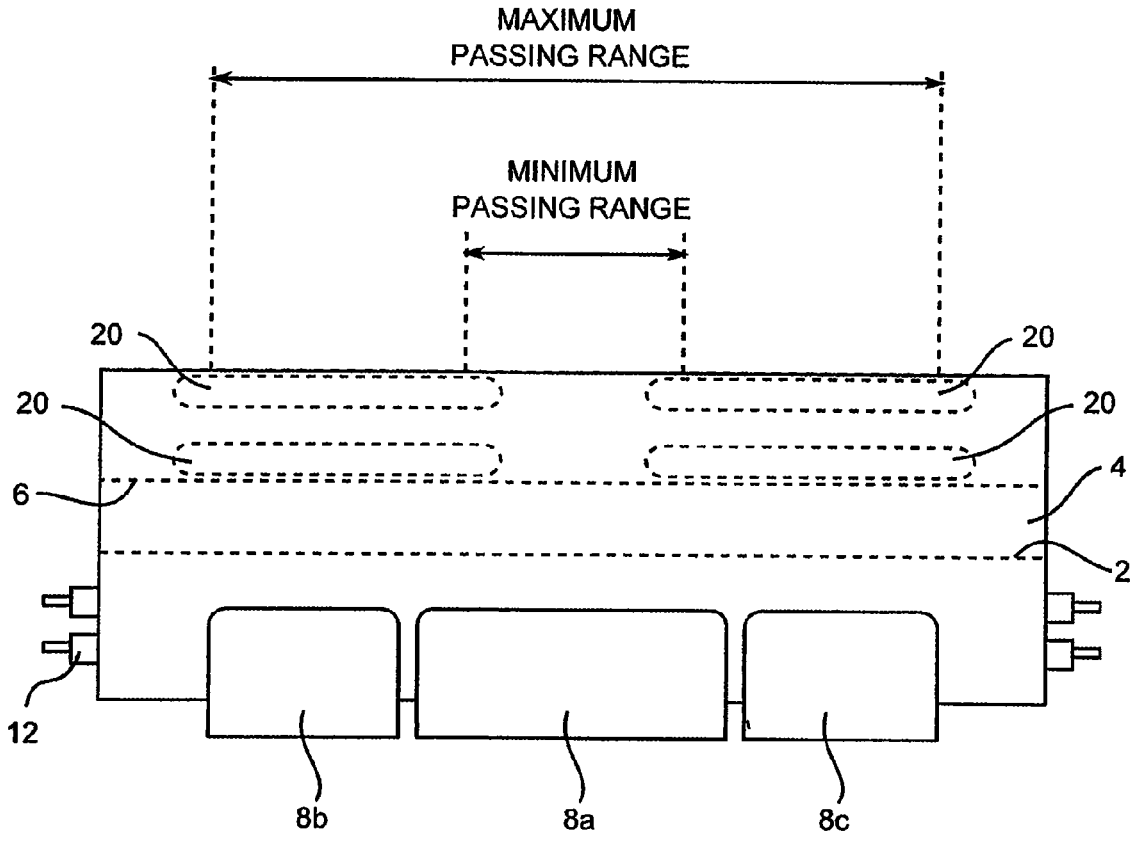
FIG. 3 is a front view of the fixing device shown in FIG. 1.

FIG. 1 is a perspective view of a fixing device 1 for explaining a fixing device according to a first embodiment of the invention. FIG. 2 is a side view of the fixing device 1. FIG. 3 is a front view of the fixing device 1 viewed from an arrow A direction shown in FIG. 2. The fixing device 1 is a device for fixing a toner image, which is transferred on a sheet P such as paper or an OHP sheet, on the sheet P with heat.

The fixing device 1 according to this embodiment includes a heating rotational member that heats and melts a toner on a sheet, a pressing roller 10, and an induction heating coil (hereinafter referred to as "IH coil") 8 as a heating device. The heating rotational member includes a fixing roller 2, a tension roller 6, and a fixing belt 4 wound and suspended around the fixing roller 2 and the tension roller 6. In the fixing device 1 according to this embodiment, the tension roller 6 included in the heating rotational member includes plural heat pipes 20. As explained in detail later, the heat pipes 20 are arranged in predetermined ranges on both the sides of a center position in an axial direction of the tension roller 6 and arranged in a circumferential direction around the rotation center of the tension roller 6.

The units of the fixing device 1 are explained below.

The fixing roller 2 of the heating rotational member is a roller that heats the fixing belt 4 that heats the sheet P in a nip section N. A conductive layer of the fixing roller 2 generates heat according to a change in a magnetic flux generated by the IH coil 8. The fixing roller 2 heats the fixing belt 4 with the heat. The fixing roller 2 includes layers such as a cored bar and an elastic layer stacked in order from the inner side thereof.

The fixing belt 4 is an endless belt wound and suspended around the fixing roller 2 and the tension roller 6. The fixing belt 4 is rotated in an arrow R direction by the fixing roller 2 driven by a not-shown driving motor. The nip section N is formed by the fixing belt 4 and the pressing roller 10 that comes into press contact with the fixing belt 4. In the nip section N, the fixing belt 4 is heated by the heat of the fixing roller 2 heated by the IH coil 8. A toner on the sheet P passing through the nip section N is heated and melted by the heat of the fixing belt 4.

When a high-frequency current is applied to the IH coil 8 from a not-shown current supply circuit, the IH coil 8 generates a magnetic flux as explained above. An eddy-current is generated by the magnetic flux in the conducive layer such as the cored bar of the fixing roller 2. The cored bar, in which the eddy-current is generated, generates heat with electric resistance thereof and the fixing roller 2 is heated. The IH coil 8 according to this embodiment is divided into an IH coil 8*a* as a center IH coil for heating the center of the fixing roller 2 and IH coils 8*b* and 8*c* as side IH coils that are arranged closer to both the sides of the IH coil 8*a* and heat both the end sides of the fixing roller 2, respectively. For example, width heated by the IH coil 8*a* is width corresponding to the sheet width (paper passing width 210 mm) of A4-R paper. When sheets ranging from a sheet having minimum passing width to the A4-R paper are caused to pass, it is possible to apply an electric current only to the IH coil 8*a* in the center and heat only a range of the fixing roller 2 corresponding to the passing width of the A4-R paper. On the other hand, when paper having passing width larger than that of the A4-R paper, for example, Ledger paper (paper passing width 279 mm) is caused to pass, since the passing width is larger than a heating range of the IH coil 8*a* in the center, the electric current is also applied to the IH coils 8*b* and 8*c* on both the sides in addition to the IH coil 8*a* to heat the entire area in an axial direction of the fixing roller 2.

In the above explanation, the heating width of the IH coil 8*a* in the center is the width corresponding to the sheet width of the A4-R paper. However, the heating width is not limited to this. The heating width may be any width as long as the width is larger than the width corresponding to passing width of a sheet having the minimum passing width at least among sheets passing through the fixing device 1. This is because, when the heating width of the IH coil 8*a* is smaller than the minimum passing width, an electric current needs to be always applied to all the IH coils and the necessity of dividing the coil is little.

The tension roller 6 is arranged in parallel to the fixing roller 2. As explained above, the fixing belt 4 is wound and suspended around the tension roller 6. The tension roller 6 is a roller for applying fixed tension to the fixing belt 4. For example, the tension roller 6 is urged by an elastic member such as a coil spring or a leaf spring to apply the fixed tension to the fixing belt 4. On the inside of the tension roller 6 according to this embodiment, the plural heat pipes 20 are arranged to uniformalize the temperature in the axial direction of the tension roller 6.

The heat pipes 20 are heat transfer elements including hollow metal pipes, wick as a material having capillarity, and working fluid. Since the working fluid is circulated in a longitudinal direction by a hollow section and the capillarity of the wick, heat can be quickly transferred to quickly eliminate a temperature difference in the axial direction of the tension roller 6.

Figure 4:
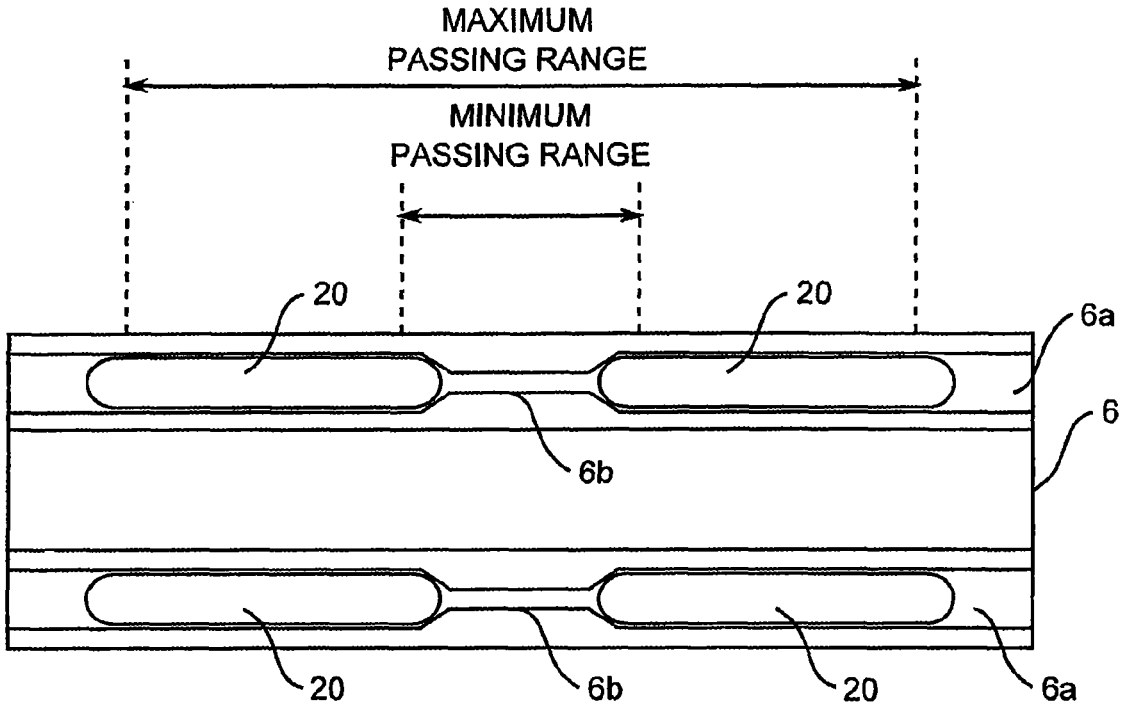
FIG. 4 is a sectional view in an axial direction of a tension roller of the fixing device according to the first embodiment.

Arrangement positions of the heat pipes 20 in the tension roller 6 according to this embodiment are explained with reference to FIG. 4. FIG. 4 is a sectional view in the axial direction of the tension roller 6 according to this embodiment. As shown in FIG. 4, the heat pipes 20 are arranged in predetermined ranges on both the sides in the axial direction of the tension roller 6 from positions closer to the center in the axial direction of the tension roller 6 to predetermined positions on end sides in the axial direction. As explained above, the plural heat pipes 20 are arrayed in the circumferential direction around the rotation center of the tension roller 6 in the predetermined ranges in the axial direction.

In this embodiment, the predetermined ranges in the axial direction in which the heat pipes 20 are arranged are, in a fixing device of a so-called "center paper passing system" with a reference of a sheet passing position set in a center position of a roller, ranges on both the sides of the tension roller 6 from positions closer to the center in the axial direction than both the ends of a passing range of a sheet having minimum width in the axial direction (hereinafter also referred to as minimum passing range) among sheets passing through the fixing device 1 to positions further on the outer sides in the axial direction than both the ends of a passing range of a sheet having maximum width in the axial direction (hereinafter also referred to as maximum passing range). "The heat pipes 20 are arranged in the predetermined ranges in the axial direction" means that ranges in which the heat equalizing effect of the heat pipes 20 is obtained are the predetermined ranges in the axial direction. In other words, the ranges in which the heat equalizing effect of the heat pipes 20 is obtained needs to be at least in the predetermined ranges.

When the heat pipes 20 are arranged in the ranges, the heat pipes 20 are arranged in a range crossing over sheet passing ranges and non-sheet passing ranges of sheets of all sizes passing through the fixing device 1. Therefore, when sheets having sheet width smaller than a heating range by the IH coil 8 are continuously caused to pass, a temperature difference caused between a sheet passing area and non-sheet passing areas of the fixing belt 4 can be reduced by the tension roller 6 including the heat pipes 20. The section of the sheet passing area can be heated by transferring the heat of the sections of the non-sheet passing areas of the fixing belt 4 to the sections of the sheet passing areas with the tension roller 6. Therefore, it is possible to effectively utilize thermal energy and reduce energy for heating to temperature necessary for fixing.

For example, when sheet fixing processing corresponding to the sheet minimum passing range in FIG. 3 is performed, the fixing roller 2 is heated only by the IH coil 8*a* and the fixing belt 4 is heated by the heat of the fixing roller 2. Since the minimum passing area is smaller than the width in the axial direction of the IH coil 8*a*, areas further on the outer sides than the minimum passing range in an area heated by the IH coil 8*a* are the non-sheet passing areas. The temperature of the fixing belt 4 rises to be higher than that in the sheet passing area. When the temperature rises, since the heat pipes 20 are arranged in the ranges on both the sides crossing over the sheet passing range and the non-sheet passing ranges, a temperature difference can be uniformalized. As explained above, since the heat of the sections of the non-sheet passing areas in the fixing belt 4 is transferred to the section of the sheet passing area of the fixing belt 4, power consumption of the IH coil 8*a* as energy for heating to the temperature necessary for fixing can be reduced.

When the width of a passing sheet is larger than the heating range of the IH coil 8*a*, heating of the fixing roller 2 is performed by using the IH coils 8*b* and 8*c* on both the sides in addition to the IH coil 8*a* in the center. In this case, the sheet does not pass the non-sheet passing areas further on the outer sides than the ends of the passing sheet in areas heated by the IH coils 8*b* and 8*c* on both the sides. Therefore, the temperature of the fixing belt 4 rises. When the temperature rises, in the case of the fixing device 1 according to this embodiment, as explained above, since the heat pipes 20 are arranged in the range crossing over the ends of the sheets in the rotation axis direction, a temperature difference caused in the fixing belt 4 can be uniformalized. As explained above, since the heat of the sections of the non-sheet passing areas is transferred to the sections of the sheet passing areas of the fixing belt 4, power consumption of the IH coils 8*a* to 8*c* as the energy for heating to the temperature necessary for fixing can be reduced.

When the electric current is applied to all the IH coils 8*a* to 8*c* to heat the fixing roller 2, induction heating hardly occurs in joint sections of the IH coil 8*a* in the center and the IH coils 8*b* and 8*c* on both the sides. Therefore, a temperature difference tends to occur in sections corresponding to the joints of the IH coil 8 and sections corresponding to the IH coils 8*a* to 8*c* in the fixing roller 2 and the fixing belt 4. In the case of the fixing device according to this embodiment, the heat pipes 20 are arranged in the range crossing over the joint sections in the rotation axis direction. Therefore, a temperature difference caused by the joint sections can be uniformalized by the action of the heat pipes 20 of the tension roller 6 that that comes into contact with the fixing belt 4. The joint sections of the IH coils 8*a* to 8*c* mean actual boundaries among the IH coils. However, it goes without saying that the temperature difference can be eliminated if the heat pipes 20 are arranged at least in a range crossing over gaps among heating ranges by the IH coils.

In the fixing device 1 according to this embodiment including the tension roller 6 in which the divided heat pipes (divided HPs) 20 are arranged and in a fixing device including a tension roller in which a single heat pipe (single HP) over an entire range in an axial direction is arranged, sheets were continuously caused to pass. A temperature distribution in the axial direction in the fixing belt 4 (a surface temperature distribution of the fixing belt 4 from the time when the fixing belt 4 separated from the tension roller 6 including the heat pipes until immediately before the fixing belt 4 was heated by the IH coil 8) was measured in both the fixing devices. Results of the temperature measurement are explained with reference to FIGS. 5 to 8. The measurement of the temperature distribution was performed by measuring the temperature in the axial direction on the surface of the fixing belt after three hundred sheets of each of sizes were caused to pass in a state in which the surface temperature of the fixing roller was set to 180° C. The results are obtained by performing measurement concerning fixing devices in which, among passing sheets, a sheet having a minimum size is Statement (ST-R) paper (paper passing width 140 mm) and a sheet having a maximum size is A4 paper (paper passing width 297 mm). Therefore, as shown in FIGS. 5 to 8, the divided heat pipes 20 arranged in the tension roller 6 are arranged in ranges on both the sides in the axial direction from positions further on the inner sides than both the ends of the ST-R paper as ends of a minimum passing range to positions further on the outer sides than both the ends of the A4 paper as ends of a maximum passing range. On the other hand, the single heat pipe is arranged in a range over an entire area of a passing range. Temperature distributions measured when the sheets are continuously caused to pass are explained with reference to the graphs.

Figure 5:
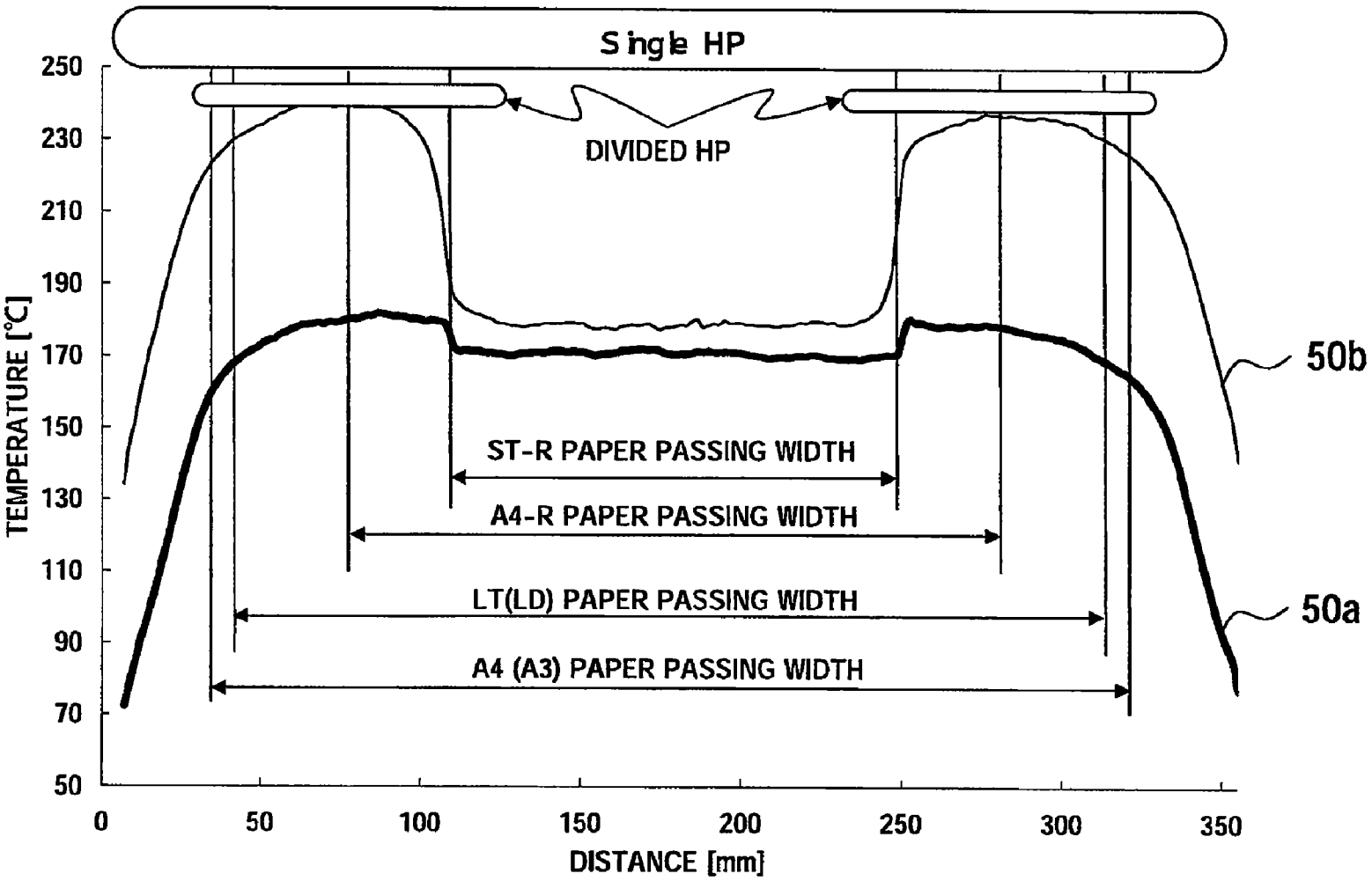
FIG. 5 is a temperature distribution chart of a fixing belt on which ST-R papers as sheets having a minimum size passing through fixing devices are caused to pass.

FIG. 5 is a temperature distribution chart of the fixing belt 4 on which three hundred ST-R papers as the minimum size sheets passing through the fixing device are caused to pass. As shown in FIG. 5, in the case of the fixing device in which the single heat pipe is arranged (a temperature distribution 50*b*), a temperature difference is large between the inside and the outside of a sheet passing area. However, in the case of the fixing device adopting the divided heat pipes according to this embodiment (a temperature distribution 50*a*), a temperature difference is substantially reduced. In the case of the single heat pipe, a temperature rise on both the end sides in the sheet passing area is large. In the case of the divided heat pipes, a temperature rise is small. It is undesirable that the temperature rises on the end sides is large and fixing temperature is uneven. This is because deterioration in a quality of an image fixed on a sheet such as fluctuation in glossiness of a fixed image is caused. In the case of the divided heat pipes, since the temperature rise at the ends is suppressed, a uniform image quality can be obtained in the axial direction.

Figure 6:
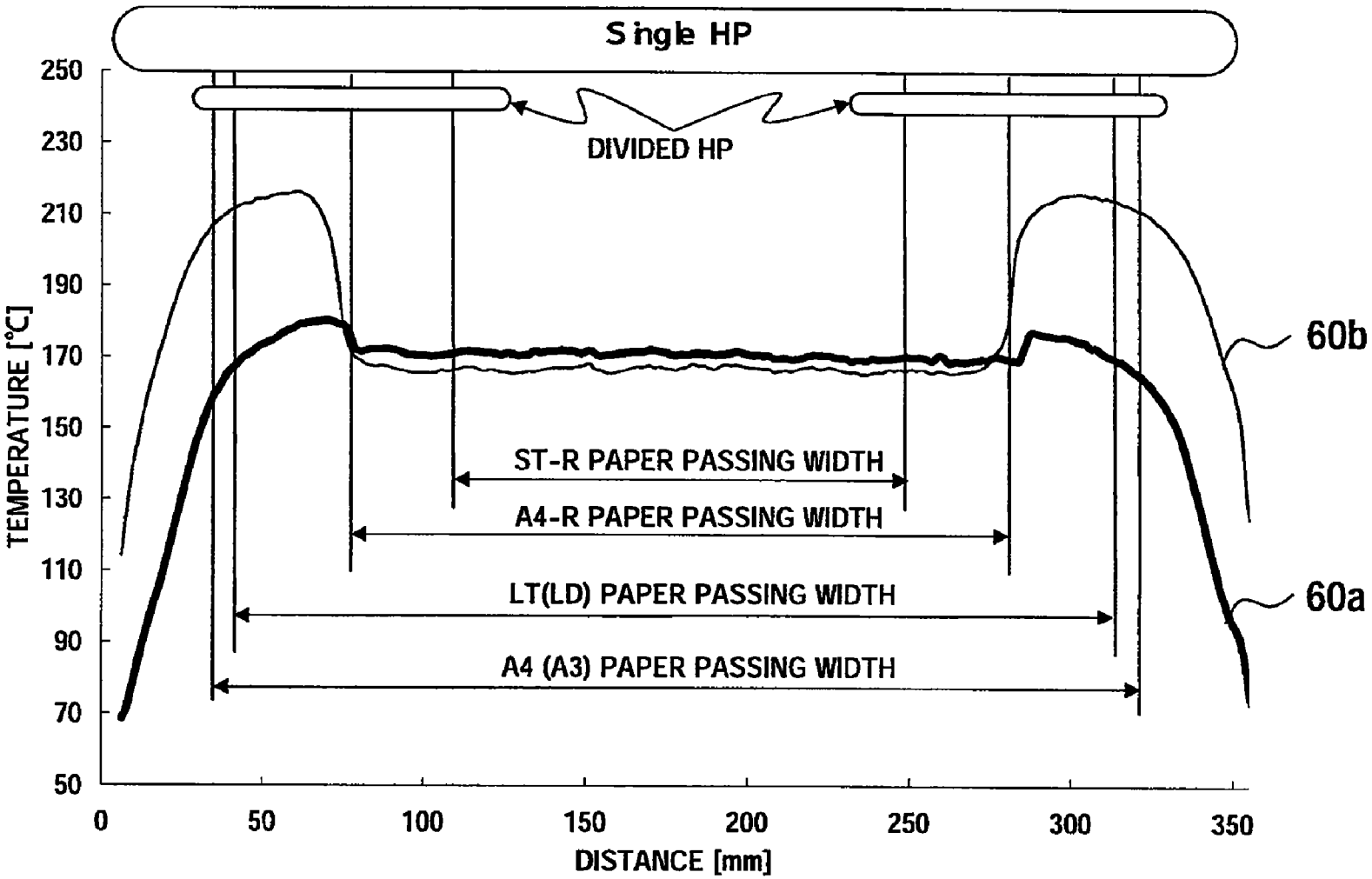
FIG. 6 is a temperature distribution chart of the fixing belt on which A4-R papers (paper passing width 210 mm) are caused to pass.

FIG. 6 is a temperature distribution chart of the fixing belt 4 on which three hundred A4-R papers (paper passing width 210 mm) are caused to pass. In this case, as in the above case, it is seen that, when the divided heat pipes according to this embodiment are adopted (a temperature distribution 60*a*), a temperature difference between the inside and the outside of the passing area is substantially reduced compared with that in the case of the single heat pipe (a temperature distribution 60*b*).

Figure 7:
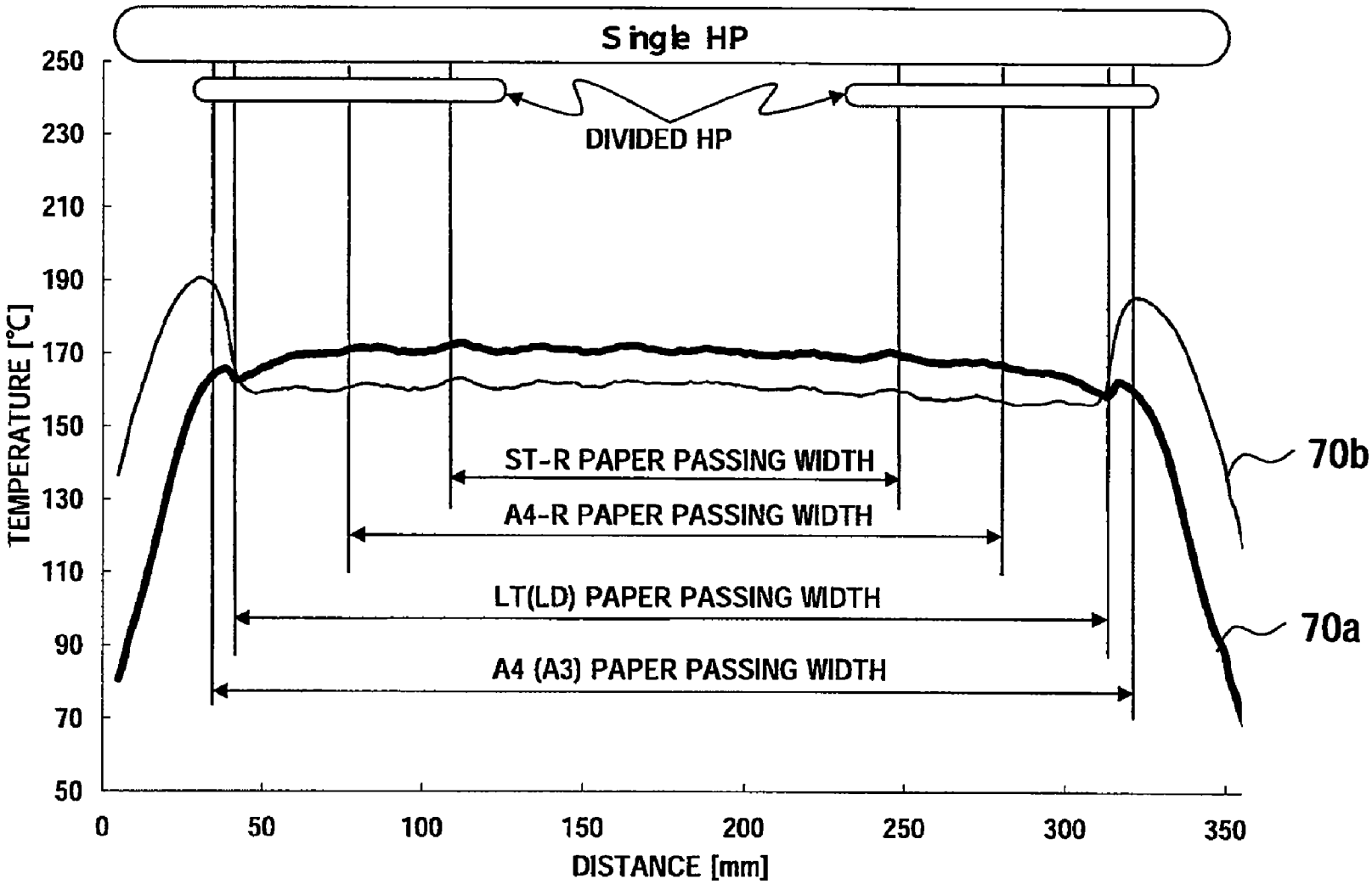
FIG. 7 is a temperature distribution chart of the fixing belt on which Ledger sheets (paper passing width 279 mm) are caused to pass.

FIG. 7 is a temperature distribution chart of the fixing belt 4 on which three hundred Ledger/Tabloid (LT) papers (paper passing width 279 mm) are caused to pass. In this case, as in the above cases, when the divided heat pipes are adopted (a temperature distribution 70*a*), a temperature difference between the inside and the outside of the sheet passing area is substantially reduced compared with that in the case of the single heat pipe (a temperature distribution 70*b*).

Figure 8:
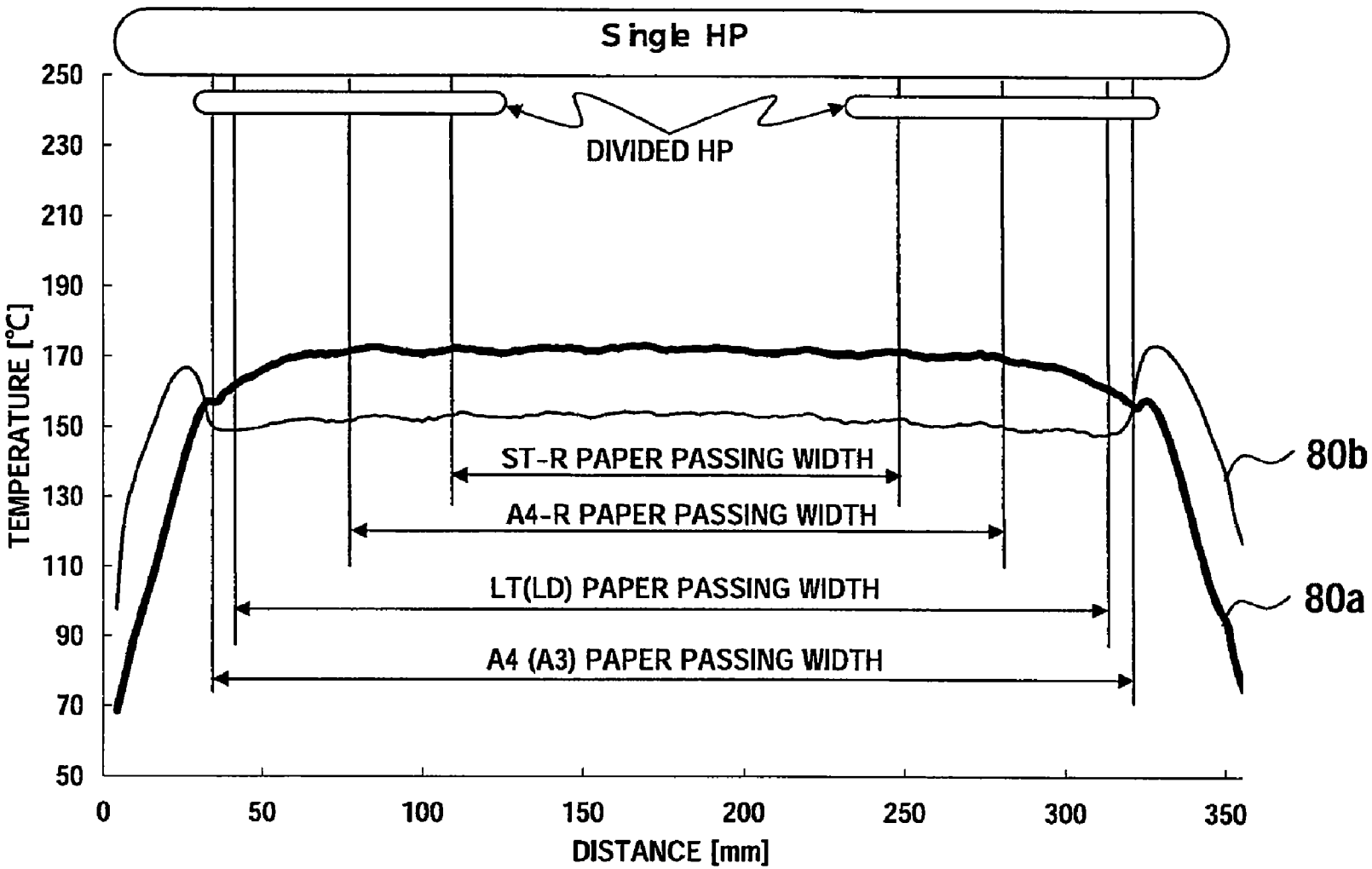
FIG. 8 is a temperature distribution chart of the fixing belt on which A4 papers (paper passing width 297 mm) as sheets having a maximum size passing through the fixing devices are continuously caused to pass.

FIG. 8 is a temperature distribution chart of the fixing belt 4 on which three hundred A4 papers (paper passing width 297 mm) as sheets having a maximum size passing through the fixing devices are caused to pass. In this case, as in the above cases, when the divided heat pipes are adopted (a temperature distribution 80*a*), a temperature difference between the inside and the outside of the sheet passing area is reduced compared with that in the case of the single heat pipe (a temperature distribution 80*b*).

As explained above, the heat pipes 20 are arranged in the ranges on both the sides in the axial direction from the positions on the inner sides of the ends in the sheet minimum passing range in the axial direction to the positions on the outer sides of the ends of the maximum passing range. Consequently, even when sheets of any size are continuously caused to pass, a temperature difference between the inside and the outside of the sheet passing area in the fixing belt 4 can be reduced significantly. On the other hand, it is undesirable to use the single heat pipe over the entire area in the axial direction of the tension roller. This is because a temperature difference is large. Therefore, with the fixing device 1 adopting the divided heat pipes according to this embodiment, there is an effect that the fixing device 1 is more excellent in the heat equalizing effect compared with the fixing device including the single heat pipe.

According to this embodiment, since a temperature rise on the outside of the sheet passing area in the fixing belt 4 is small, there is also an effect that thermal efficiency is high. In the case of the single heat pipe, as explained above, a temperature difference is large between the inside and the outside of the sheet passing area and waste of thermal energy is large.

When the heat pipes 20 are divided in the axial direction and arranged, effects explained below are further obtained. In the fixing device 1 according to this embodiment, the heat pipes 20 of the tension roller 6 are divided in the axial direction and arranged on both the sides in the axial direction. Consequently, for example, when heating is performed by the IH coils 8*a* to 8*c*, if a passing range of continuously passing sheets is smaller than the maximum passing range, a temperature difference occurs between the sheet passing area in the fixing belt 4 and the non-sheet passing areas on the outer sides of the sheet passing area. In such a case, as explained above, heat is transferred from a high-temperature section to a low-temperature section according to the action of the heat pipes 20 of the tension roller 6 that comes into contact with the fixing belt 4. The heat of the fixing belt 4 is equalized. Since the heat pipes 20 are divided, there is a merit that a temperature difference less easily occurs in the fixing belt 4 and heat in the center of the sheet passing area is not deprived by the heat pipes. In other words, since the transfer of heat is performed only in ranges near the sheet ends where heat equalization is necessary, there is an effect that waste of thermal energy is small. On the other hand, it is undesirable that the undivided single heat pipe over the entire range in the axial direction of the tension roller 6 is used. This is because heat in the center of the sheet passing area may also be transferred to other sections having lower temperatures to cause fluctuation in temperature in the axial direction and thermal efficiency falls.

A method of manufacturing the tension roller 6 according to this embodiment is explained. A roller section of the tension roller 6 can be manufactured by the extrusion molding method using, for example, an aluminum material. Specifically, a roller in which insertion holes 6*a* in the longitudinal direction for inserting the heat pipes 20 are formed by extrusion molding using the aluminum material.

After the roller is formed, machining for forming small diameter sections 6*b* for positioning distal ends of the heat pipes 20, which are inserted into the insertion holes 6, in predetermined positions closer to the center than positions of the ends of the minimum passing range is performed. The small diameter sections 6*b* are formed by reducing an inner diameter of ranges further on the inner side than the minimum passing range of the insertion holes 6*a* having a uniform diameter formed by extrusion molding to be smaller than an outer diameter of the heat pipes 20. Specifically, force is applied to the range of the roller to crush the range, reduce the diameter of the entire roller, and reduce the insertion holes 6*a* on the inside to form the small diameter sections 6*b* in a range corresponding to the range.

In this way, the heat pipes 20 are inserted into the through holes 6*a* in which the small diameter sections 6*b* are formed in the range on the inner side of the minimum passing range of the through holes 6*a*. Then, the distal ends of the heat pipes 20 come into contact with both the ends of the small diameter sections 6*a* and stop. This makes it possible to easily position the heat pipes 20.

When the roller is reduced in diameter, an outer circumferential surface of the roller is deformed. Therefore, after the roller is crushed, the surface of the roller is shaved again to form the roller in a cylindrical shape.

After the heat pipes 20 are inserted into the insertion holes 6*a* formed in this way, the roller is heated. The working fluid on the inside is evaporated by the heating. The heat pipes 20 are plastically deformed to expand to the outer side in the radial direction thereof by a vapor pressure of the evaporation. Consequently, the heat pipes 20 thermally join with inner surfaces of the insertion holes 6*a* of the tension roller 6 in which the heat pipes 20 are inserted. After the tension roller 6 and the heat pipes 20 are joined, bearing sections of the tension roller 6 are attached to both the ends of the tension roller 6. According to the method explained above, it is possible to manufacture plural tension rollers 6 arrayed in a predetermined range in the axial direction of the heat pipes 20.

With such a tension roller 6, in the insertion holes 6*a* in which the heat pipes 20 are inserted, ranges in which the heat pipes 20 are not inserted are pierced through in the axial direction as the small diameter sections 6*b*. Therefore, there is a merit that the tension roller 6 is less easily filled with heat. On the other hand, when insertion holes are formed by a machining method such as grinding only in the ranges in which the heat pipes 20 are arranged, although the positioning of the heat pipes 20 is possible, sections not pierced through tend to be filled with heat and may prevent elimination of a temperature difference. Further, since a heat capacity increases in the sections not pierced through, this causes an increase in warming-up time and deterioration in temperature rise performance. Heat resistance increases according to the increase in the heat capacity and temperature unevenness tends to occur in the temperature on a belt surface of the fixing belt 4.

As a material of the tension roller 6, aluminum having high thermal conductivity is preferable. However, a low-cost iron material may be used. As explained above, the heat pipes 20 are plastically deformed in the diameter expanding direction to metallically join the tension roller 6 and the heat pipes 20. Therefore, as the material of the tension roller 6, a material having a coefficient of thermal expansion lower than that of the heat pipes 20 needs to be used. Therefore, when the hollow pipes for the heat pipes 20 are formed of aluminum, stainless steel or iron having a coefficient of thermal expansion lower than that of aluminum is used as a pipe material of the tension roller 6.

The other components of the fixing device 1 according to this embodiment are explained below.

The pressing roller 10 is set in press contact with the fixing roller 2 by a not-shown pressing mechanism to keep fixed nip width. The pressing roller 10 nips and carries a sheet P in cooperation with the belt surface of the fixing belt 4. A toner on the sheet P heated and melted by the fixing belt 4 is compression-bonded to the sheet P by the pressure of the pressing roller 10. The pressing roller 10 is formed by coating silicone rubber, fluorine rubber, or the like around a cored bar as an elastic layer.

A heating lamp 12 is a heating device for heating the surface temperature of the pressing roller 10 to the temperature necessary for the fixing processing. The heating lamp 12 is arranged in the pressing roller 10 in parallel to the axial direction of the pressing roller 10. Usually, the heating lamp 12 is controlled to be turned on in warming-up to heat the pressing roller 10 and turned off in a standby state in which the fixing processing is not performed.

With the fixing device 1 according to this embodiment, for example, when an induction heating range by the IH coil 8 and a range of continuously passing sheets do not coincide with each other, a temperature difference in the axial direction that occurs in the fixing belt 4 can be uniformalized by the tension roller 6 in which the heat pipes 20 are arranged in the range crossing over the ends of the sheets. Therefore, it is possible to provide a fixing device with small fluctuation in a temperature difference in the rotation axis direction of the heating rotational member. Since the fluctuation in a temperature difference is small, it is possible to form a satisfactory fixed image with less glossiness unevenness and the like. Since the heat of the non-sheet passing areas is transferred to the sheet-passing area, there is no waste in thermal efficiency and energy saving can be realized.

In this embodiment, the heat pipes 20 of the tension roller 6 are arranged in the ranges on both the sides in the axial direction of the roller from the positions closer to the center than the ends of the minimum passing range of passing sheets to the positions further on the outer sides than the ends of the maximum passing range of the passing sheets. However, the positions of the ends on the outer sides of the heat pipes 20 are not limited to these positions. For example, the positions of the ends on the outer sides of the heat pipes 20 can be positions further on the outer sides than ends of the divided IH coils 8*b* and 8*c* on the outer sides closer to the IH coil 8*a*. This is because, even when the positions of the ends on the outer sides of the heat pipes 20 are arranged in this way, a temperature difference near the sheet ends is larger in the case of the heating by only the IH coil 8*a* and a temperature difference elimination effect can be sufficiently obtained. This is because, in the heating by the IH coils arranged on the outer sides, it is unnecessary to heat a non-paper passing section more than necessary.

In this embodiment, the fixing device 1 in which the heat pipes 20 are arranged in the tension roller 6 is explained. However, the arrangement of the heat rollers 20 is not limited to this. The heat pipes 20 can be arranged in one of a roller in which a temperature difference occurs in the rotation axis direction because of continuous passage of sheets such as the fixing roller 2 or the pressing roller 10 of the fixing device 1 and a roller that comes into contact with a member in which a temperature difference occurs. Alternatively, the heat pipes 20 can be arranged in these plural rollers. This makes it possible to provide the fixing device 1 with small fluctuation in fixing temperature.

Second Embodiment

Figure 9:
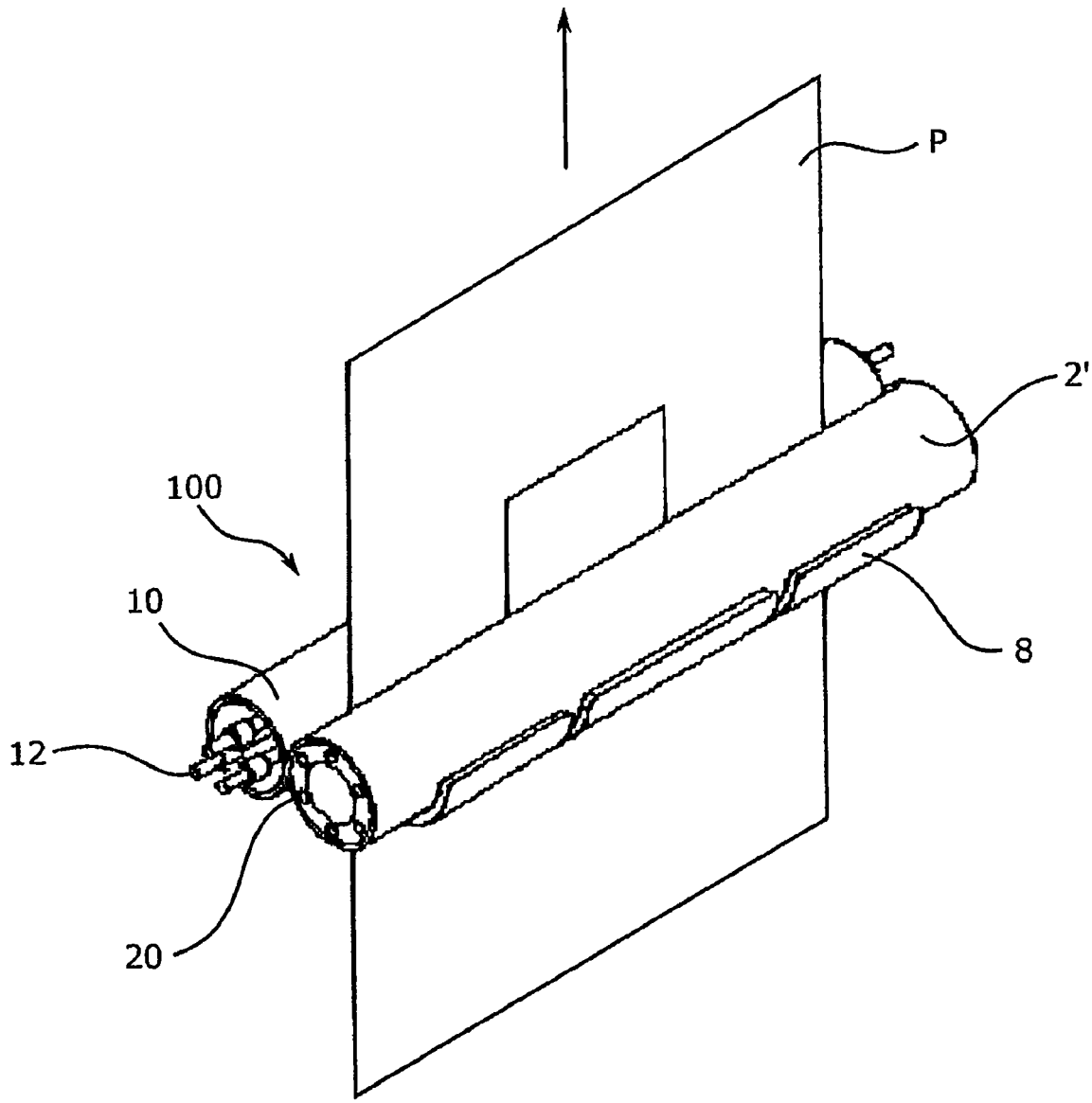
FIG. 9 is a perspective view of a fixing device according to a second embodiment of the invention.
Figure 10:
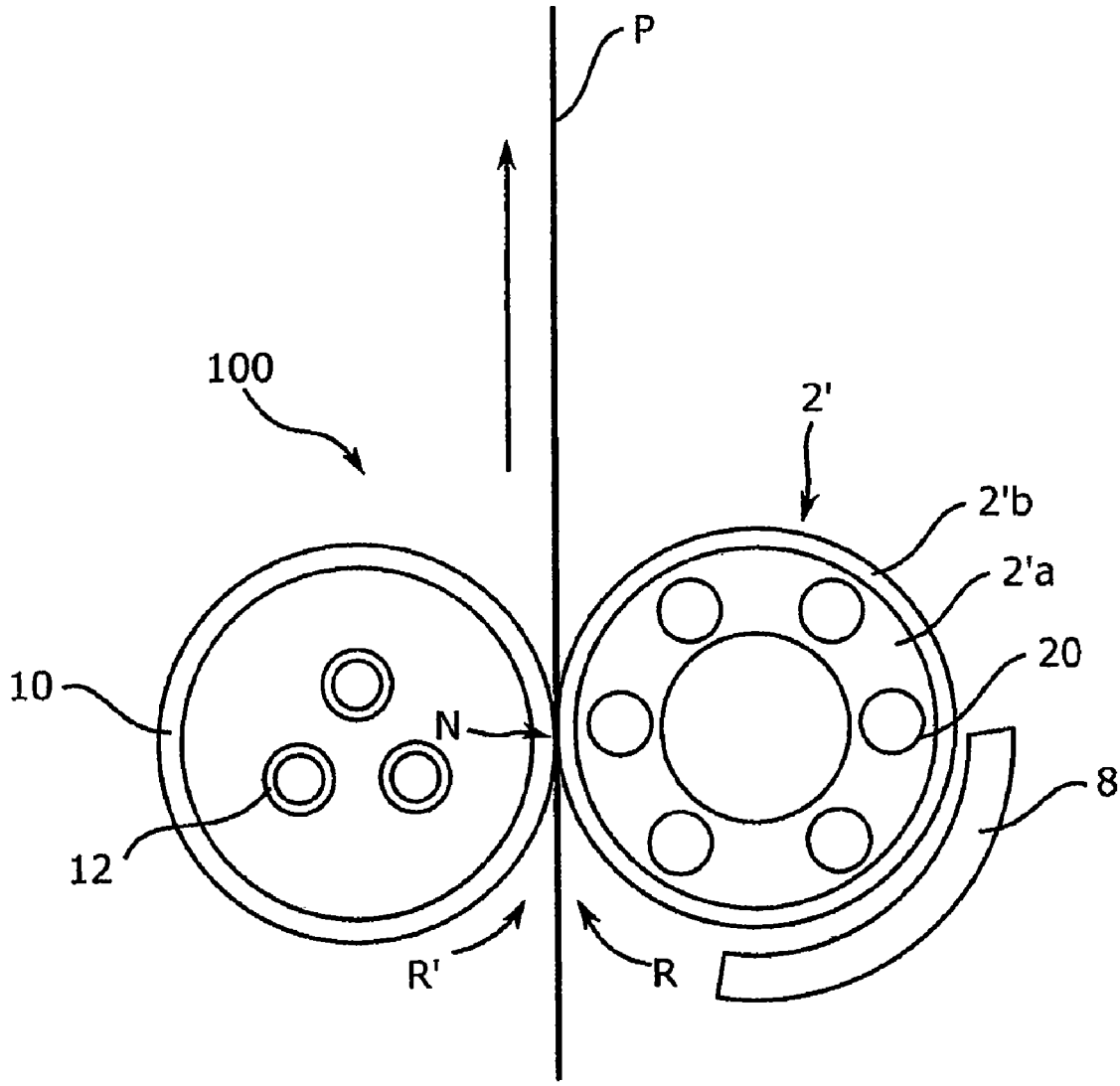
FIG. 10 is a side view of the fixing device according to the second embodiment.
Figure 11:
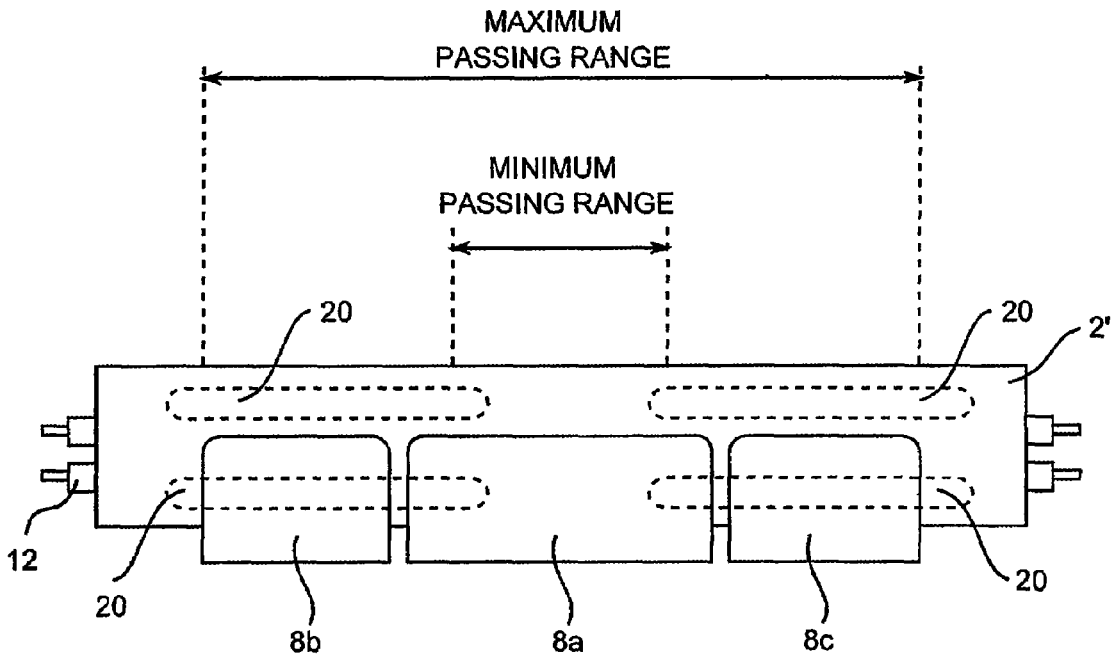
FIG. 11 is a front view of the fixing device according to the second embodiment.

A second embodiment of the invention is explained. FIG. 9 is a perspective view of a fixing device 100 according to the second embodiment. FIG. 10 is a side view of the fixing device 100. FIG. 11 is a front view of the fixing device 100.

The fixing device 100 according to the second embodiment is different from the fixing device according to the first embodiment in that the fixing device 100 is a fixing device of a roller type in which a heating rotational member includes only a fixing roller (a heating roller) 2'. In the fixing device 100 according to this embodiment, the heat pipes 20 are arranged in a predetermined range in the axial direction in the fixing roller 2'. The fixing device 100 according to the second embodiment is explained below. Components same as those of the fixing device 1 according to the first embodiment are denoted by the same reference numerals and signs and explanation of the components is omitted.

The fixing device 100 according to this embodiment includes the fixing roller 2' included in the heating rotational member, the IH coil 8 that heats the fixing roller 2', and the pressing roller 10.

A configuration of the fixing roller 2' is explained. The fixing roller 2' is a roller that heats and melts a toner on a sheet in the nip section N. Specifically, according to a change in a magnetic flux generated by the IH coil 8, a conductive layer of the fixing roller 2' generates heat and the toner is heated and melted by the heat. The fixing roller 2' includes a metal roller 2'*a* as a cored bar of the fixing roller 2' and a rubber layer 2'*b* that is formed on the outer side of the metal roller 2' and imparts elasticity to a roller surface to secure fixed nip width. In the fixing roller 2' according to this embodiment, the plural heat pipes 20 are arranged in insertion holes formed in the metal roller 2'*a*, Ranges in the axial direction in which the heat pipes 20 are arranged are the same as those in the case of the tension roller 6 according to the first embodiment. The ranges are ranges on both the sides in the axial direction in the fixing roller 2' from positions closer to the center in the axial direction than both the ends of a passing range of a sheet having minimum width in the axial direction (a minimum passing range) among sheets passing through the fixing device 100 to positions further on the outer sides in the axial direction than both the ends of a passing range of a sheet having maximum width in the axial direction (a maximum passing range). Since the heat pipes 20 are arranged in the ranges, the heat pipes 20 are arranged in a range crossing over a sheet-P passing range and a sheet-P non-passing range of the fixing roller 2' for sheets of all sizes passing through the fixing device 1. Therefore, when sheets having width smaller than the heating range are continuously caused to pass, it is possible to reduce a temperature difference that occurs between a sheet passing area and a non-sheet passing area of the fixing roller 2'. The sheet passing area can be heated by transferring the heat of non-sheet passing area to the sheet passing area. Therefore, it is possible to reduce the energy necessary for heating to the temperature necessary for fixing.

As in the first embodiment, when an IH coil is divided, induction heating less easily occurs and a temperature different tends to occur in sections in the fixing roller 2' corresponding to joint sections of divided IH coils. However, in the case of the fixing device 100 according to this embodiment, as shown in FIG. 11, the heat pipes 20 are arranged in the area crossing over the joint sections among the IH coil 8*a* and the IH coils 8*b* and 8*c* in the fixing roller 2'. Therefore, it is possible to eliminate fluctuation in temperature that occurs in the joint sections. Consequently, no difference occurs in an image quality between a fixed image corresponding to the joint sections and a fixed image corresponding to the other sections.

As explained above, according to this embodiment, it is possible to provide the fixing device 100 having a less temperature difference in the axial direction of the fixing roller 2' as the heating rotational member and fix an image having a high image quality on a sheet.

In the explanation of this embodiment, it is assumed that the heat pipes 20 are provided on the inside of the fixing roller 2'. However, the arrangement of the heat pipes 20 is not limited to this. When heat pipes are arranged in the predetermined range in the axial direction in the pressing roller 10, a temperature difference in the axial direction in the nip section can also be eliminated. Heat pipes may be arranged in both the fixing roller 2' and the pressing roller 10. In this case, the heat equalizing effect in the axial direction can be further improved.

In this embodiment, the heat pipes of the fixing roller 2' are arranged in the ranges on both the sides in the axial direction of the roller from the positions further on the inner sides than the ends of the minimum passing range of passing sheets to the positions further on the outer sides than the ends of the maximum passing range of the passing sheets. However, the positions of the ends on the outer sides of the heat pipes 20 are not limited to these positions. As explained in the first embodiment, for example, the positions of the ends on the outer sides of the heat pipes 20 can be positions further on the outer sides than the positions of ends of the divided IH coils 8*b* and 8*c* on the outer sides closer to the IH coil 8*a* in the center. Even when the positions of the ends on the outer sides of the heat pipes 20 are arranged in this way, it is possible to realize heat equalization according to a heat transfer effect of the heat pipes in ranges in which the heat pipes are interposed even in a non-heating area and reduce temperature unevenness of the belt surface.

Third Embodiment

Figure 12:
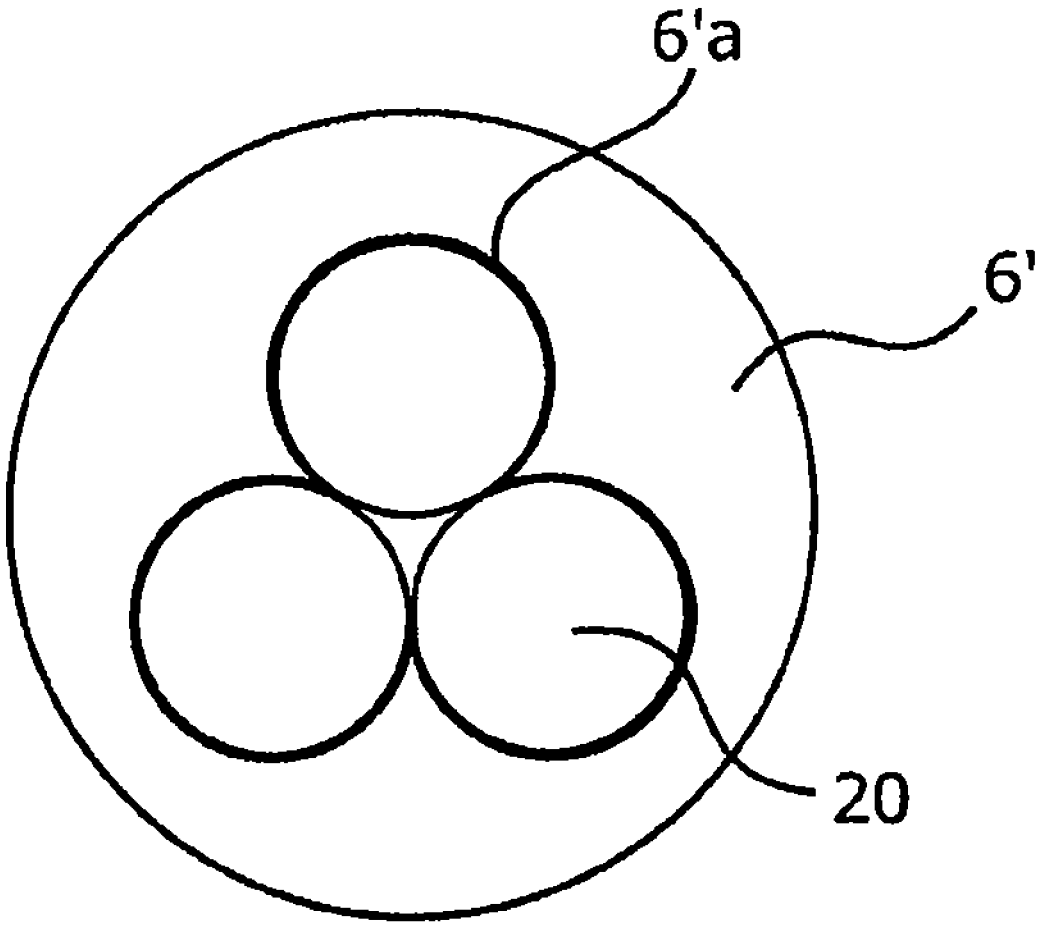
FIG. 12 is a sectional view of a tension roller according to a third embodiment of the invention.

A third embodiment of the invention is explained. FIG. 12 is a sectional view of a tension roller 6' according to the third embodiment. The tension roller 6' according to the third embodiment is different from the tension roller 6 according to the first embodiment in an arrangement method for the heat pipes 20.

In the case of the tension roller 6 according to the first embodiment, as shown in FIGS. 1 and 2, the independent insertion holes 6*a* are formed and the heat pipes 20 are arrayed on the inside of the tension roller 6. However, in the case of this embodiment, as shown in FIG. 12, an insertion hole 6'*a* in which the plural heat pipes 20 are inserted is integral. In the case of the tension roller 6' shown in FIG. 12, an integral hole in which three heat pipes 20 are inserted is formed. In the case of the integral insertion hole 6'*a*, the inserted heat pipes 20 are fixed in the insertion hole 6'*a* in contact with one another.

When the insertion hole 6'*a* of the heat pipes 20 is integral as in the tension roller 6' according to this embodiment, a volume of a hollow section in the tension roller 6' is increased compared with the tension roller 6 according to the first embodiment. Therefore, there is an advantage that a heat capacity is small and the tension roller 6' is less easily filled with heat. On the other hand, it is undesirable that the tension roller 6 is excessively filled with heat. This is because the heat adversely affects heat transfer realized by the heat pipes 20 arranged in the predetermined positions.

A method of manufacturing the tension roller 6' according to this embodiment is the same as that in the first embodiment. First, a hollow roller shown in FIG. 12 in which the integral insertion hole 6'*a* is formed is formed by extrusion molding. To position the distal ends of the heat pipes 20 to be inserted, the formed roller is crushed to reduce an inner diameter of the insertion hole 6'*a* in a range closer to the center than the ends in the minimum passing range. Consequently, small diameter sections for positioning the distal ends of the heat pipes 20, which are inserted into the insertion holes 6'*a*, in predetermined positions further on the inner sides than the ends of the minimum passing range are formed. After the roller surface is machined to level irregularities of a roller outer circumference surface caused by crushing the roller, the three heat pipes 20 are inserted into the integral insertion hole 6'*a*.

Thereafter, the tension roller 6' is heated to plastically deform the heat pipes 20 in the diameter expanding direction and thermally join the heat pipes 20 and the tension roller 6'. In the case of the integral insertion hole 6'*a*, as explained above, the heat pipes 20 are fixed in contact with one another.

According to the third embodiment, a heat capacity of the roller including the heat pipes 20 can be reduced. This makes it possible to more efficiently perform the heat transfer by the heat pipes 20 and effectively eliminate a temperature difference. Since the insertion hole for the heat pipes 20 is the insertion hole 6'*a* of the integral shape, it is easy to machine the tension roller 6' and it is possible to reduce cost.

In the explanation of this embodiment, the heat pipes 20 are provided in the tension roller 6'. However, the arrangement of the heat pipes 20 is not limited to this. When the heat pipes 20 are arranged in the fixing roller 2', the integral insertion hole can also be formed to arrange the heat pipe.

In the examples explained in the embodiments, a so-called "center paper passing system" for carrying a sheet in a center position in a direction orthogonal to a carrying direction is adopted. However, a paper passing system is not limited to this. It goes without saying that it is possible to adopt a paper passing system for causing a sheet to pass a position closer to one of the ends in the direction orthogonal to the carrying direction.

In the explanation of the embodiments, the fixing roller is heated by the IH coil. However, heating by the IH coil is not limited to this. It is also possible to adopt a fixing belt having a conductive layer and heat the fixing belt with the IH coil. In this case, as in the embodiments, it is possible eliminate a temperature difference that occurs in the fixing belt.

The invention can be carried out in other various forms without departing from the spirit or main characteristics of the invention. Therefore, the embodiments are merely illustrations in every aspect and should not be limitedly interpreted. The scope of the invention is indicated by claims and is not restricted by the text of the specification. All modifications and various alterations, replacements, and improvements belonging to the scope of equivalents of claims are within the scope of the invention.

As explained in detail above, according to the invention, it is possible to provide a technique for preventing a temperature rise in the non-sheet passing area in the fixing device.

What is claimed is:

1. A fixing device comprising:

a heating rotational member configured to include at least one roller and heat a toner transferred on a sheet;

a pressing roller configured to nip and carry the sheet in cooperation with the heating rotational member;

a heating device configured to heat the heating rotational member; and heat pipes arranged, on an inside of at least one of the roller of the heating rotational member and the pressing roller, in ranges on both sides in an axial direction of the roller from positions closer to a center in the axial direction than both ends of a minimum sheet passing range in the axial direction of the roller of the nipped and carried sheet to positions further on outer sides in the axial direction than both ends of a maximum sheet passing range.

2. The device according to claim 1, wherein a plurality of the heat pipes are arrayed in a circumferential direction around a rotation center of the roller in which the heat pipes are arranged.

3. The device according to claim 1, wherein the heating rotational member includes:

a fixing roller arranged to be opposed to the pressing roller;

a tension roller arranged in parallel to the fixing roller; and an endless fixing belt wound and suspended around the fixing roller and the tension roller, and the fixing roller and the tension roller apply tension to the fixing belt in cooperation with each other.

4. The device according to claim 3, wherein the heat pipe is arranged on an inside of the tension roller.

5. The device according to claim 3, wherein the heat pipes are arranged on an inside of the fixing roller.

6. The device according to claim 1, wherein the heating rotational member is a fixing roller with which the pressing roller comes into press contact, and the heat pipes are arranged on an inside of the fixing roller.

7. The device according to claim 1, wherein the heat pipes are arranged on an inside of the pressing roller.

8. The device according to claim 1, wherein the heating device is plural IH coils divided in the axial direction, and the heat pipes are arranged in a range crossing over joints of the plural IH coils in the axial direction.

9. The device according to claim 1, wherein the roller in which the heat pipes are arranged includes, in a range closer to the center in the axial direction than both the ends of the minimum range of the sheet having the passing range, insertion holes, in which the heat pipes are inserted, having a small diameter section smaller than an outer diameter of the heat pipes.

10. The device according to claim 9, wherein the insertion holes are formed as an integral hole branching to plural portions, and the heat pipes are fixed on an inside of the insertion hole in contact with one another.

11. The device according to claim 1, wherein the roller in which the heat pipes are arranged has a coefficient of thermal expansion lower than that of the heat pipes.

12. A fixing device comprising:

a heating rotational member configured to include at least one roller and heat a toner transferred on a sheet;

a pressing roller configured to nip and carry the sheet in cooperation with the heating rotational member;

a center IH coil configured to heat, in the at least one roller included in the heating rotational member, a first range wider than a minimum sheet passing range in an axial direction of the roller of the nipped and carried sheet;

side IH coils configured to heat, in the at least one roller included in the heating rotational member, second ranges located on both sides of the heating range of the center IH coil in the axial direction; and heat pipes dividedly arranged in the axial direction on an inside of at least one of the at least one roller included in the heating rotational member and the pressing roller and arranged in a range in the axial direction from positions closer to a center in the axial direction than both ends of the minimum sheet passing range to positions further on outer sides than side ends which close to the first range in the second range.

13. The device according to claim 12, wherein a plurality of the heat pipes are arrayed in a circumferential direction around a rotation center of the roller in which the heat pipes are arranged.

14. The device according to claim 12, wherein the heating rotational member includes:

a fixing roller arranged to be opposed to the pressing roller;

a tension roller arranged in parallel to the fixing roller; and an endless fixing belt wound and suspended around the fixing roller and the tension roller, and the fixing roller and the tension roller apply tension to the fixing belt in cooperation with each other.

15. The device according to claim 14, wherein the heat pipe is arranged on an inside of the tension roller.

16. The device according to claim 14, wherein the heat pipes are arranged on an inside of the fixing roller.

17. The device according to claim 12, wherein the heating rotational member is a fixing roller with which the pressing roller comes into press contact, and the heat pipes are arranged on an inside of the fixing roller.

18. The device according to claim 12, wherein the heat pipes are arranged on an inside of the pressing roller.

19. The device according to claim 12, wherein the roller in which the heat pipes are arranged includes, in a range closer to the center in the axial direction than both the ends of the minimum range of the sheet having the passing range, insertion holes, in which the heat pipes are inserted, having a small diameter section smaller than an outer diameter of the heat pipes.

20. The device according to claim 12, wherein the insertion holes are formed as an integral hole branching to plural portions, and the heat pipes are fixed on an inside of the insertion hole in contact with one another.

* * * * *